US006457891B1

(12) United States Patent
Bredacts

(10) Patent No.: US 6,457,891 B1
(45) Date of Patent: Oct. 1, 2002

(54) REFILLABLE COSMETIC POWDER DISPENSER

(76) Inventor: Timea I. Bredacts, 2843 Day Ave., Coconut Grove, FL (US) 33133

( * ) Notice: Subject to any disclaimer, the term of this patent is extended or adjusted under 35 U.S.C. 154(b) by 0 days.

(21) Appl. No.: 09/819,445

(22) Filed: Mar. 28, 2001

(51) Int. Cl.[7] ..... A46B 11/00

(52) U.S. Cl. ..... 401/123; 401/82; 401/124; 401/280; 401/281

(58) Field of Search ..... 401/82, 123–125, 401/135, 269, 280, 281; 132/293, 298–301, 304–307

(56) References Cited

U.S. PATENT DOCUMENTS

| | | | | | |
|---|---|---|---|---|---|
| 1,274,697 | A | * | 8/1918 | Dynowsky | 401/123 |
| 1,588,633 | A | * | 6/1926 | Taylor | 401/123 |
| 1,727,636 | A | * | 9/1929 | Denman | 401/82 |
| 3,729,011 | A | * | 4/1973 | Gleicher | 132/298 |
| 4,626,119 | A | | 12/1986 | Ladd | 401/123 |
| 4,630,954 | A | | 12/1986 | Ladd | 401/123 |
| 4,647,240 | A | | 3/1987 | Ladd et al. | 401/123 |
| 4,652,162 | A | | 3/1987 | Ladd et al. | 401/123 |
| 4,671,690 | A | | 6/1987 | Ladd et al. | 401/123 |
| 4,728,211 | A | | 3/1988 | Ladd | 401/123 |
| 4,944,625 | A | | 7/1990 | Futter et al. | 401/153 |
| 4,974,981 | A | | 12/1990 | Bennett | 401/123 |

* cited by examiner

*Primary Examiner*—Gregory L. Huson
*Assistant Examiner*—Tuan Nguyen
(74) *Attorney, Agent, or Firm*—CUSPA Technology Law Associates

(57) ABSTRACT

A refillable cosmetic powder dispenser is provided for use with a retractable cosmetic powder brush. The refillable cosmetic powder dispenser includes a scoop refiller, a scoop refiller cap, a brush adapter, and a center rotational mechanism connecting the scoop refiner and the brush adapter, Both scoop refiller and brush adapter have one closed end having a plurality of spaced openings, which can be aligned for dispensing powder by manual rotation through the center rotational mechanism. The scoop refiller has an open end with an inclined opening in a scoop like shape for convenient refill of cosmetic powder. Additionally, the refillable cosmetic powder dispenser can further have a mirror on top of the scoop refiller cap for cosmetic applications. The refillable cosmetic powder dispenser can be assembled with a retractable cosmetic powder brush as a refillable cosmetic powder applicator.

20 Claims, 3 Drawing Sheets

REFILLABLE COSMETIC POWDER DISPENSER

FIELD OF THE INVENTION

The present invention relates in general to the field of cosmetic powder application device and more particularly to a refillable cosmetic powder dispenser for a travel size cosmetic powder applicator.

BACKGROUND OF THE INVENTION

Cosmetic powder dispensers and applicators are known in the art. There are mainly two types of dispensers. One type delivers powder from a container underneath the cosmetic brush bristles and through the body of the bristles to the tips. With this mechanism, brushes contain powder on the main portions of the bristles as well as the tips. Since the user only uses the bristle tips when applying the powder, powder carried on main body of the bristles are not needed. Therefore, not only the brushes are messy, powder is wasted.

The second type dispenser delivers powder from a powder storage container located above the bristles. Pressurized delivery and gravity delivery with a mechanical control mechanism have both been utilized in the devices with the top delivery mechanism. Using this type of dispenser, only the tips of the bristles are charged with powder. Therefore, it saves powder, and main body of bristles are not charged undesirably by powder, which is more effective, and cleaner than the first type.

However, these top powder delivery dispensers disclosed by the prior art lack cost effective and convenient powder refill mechanisms. Powder refill is an important aspect of a dispenser's function, because frequent refill is desired in certain circumstances. Some prior art dispensers utilize manufacturer pre-packed and sealed powder containers as the powder supply, such as the one disclosed in U.S. Pat. No. 4,974,981. U.S. Pat. Nos. 4,728,211, 4,671,690, 4,652,162, 4,647,240, 4,630,954, and 4,626,119 disclose cosmetic powder dispensers and applicators with various mechanical designs to facilitate powder delivery. With these dispensers, cosmetic powder is filled in a capsule, and the capsule is inserted into the delivery portion of the dispensers. This design is most suitable for a manufacturer pre-packed capsule. Additionally, these dispensers all utilize a peripheral rotation design for aligning the openings for powder delivery.

Since the consumption of some cosmetic powder, such as face powder, in a regular cosmetic application is not small, it is desirable that the dispensers provide a mechanism for a convenient refill. Moreover, manufacturer pre-packed powder capsules are more expensive, in comparison to loose powder sold in large containers.

It is apparent from above discussion that there is a need for a refillable cosmetic powder dispenser that facilitates frequent refills by users.

SUMMARY OF THE INVENTION

In one embodiment, the present invention relates to a refillable cosmetic powder dispenser, which comprises a scoop refiner having a first and a second opposite ends, the first end being open with an inclined opening in a scoop like shape for refill of cosmetic powder, and the second end being closed, and having a plurality of spaced openings for dispensing the cosmetic powder; a scoop refiller cap for covering the first end of the scoop refiller; a brush adapter having a first and second opposite ends, the first end being closed and having a plurality of spaced openings and the second end being open for adapting to a cosmetic brush; and a central rotational means connecting the second end of the scoop refiller and the first end of the brush adapter, wherein the scoop refiller and the brush adapter can be rotated relative to each other through the central rotational means.

In a further embodiment, the present invention relates to a refillable cosmetic powder applicator, which comprises the refillable cosmetic powder dispenser of the present invention, and a retractable cosmetic brush adaptable to the refillable cosmetic powder dispenser. The retractable cosmetic brush comprises a brush holder having a open end and an opposite closed end, the open end being insertable into the brush adapter of the refillable cosmetic powder dispenser; cosmetic brush bristles disposed in the brush holder; and a retraction means for moving the cosmetic brush bristles vertically out and in the open end of the brush holder.

In an additional embodiment, the present invention further relates to a cosmetic kit, which comprises the refillable cosmetic powder dispenser of the present invention, a retractable cosmetic brush adaptable to the refillable cosmetic powder dispenser and cosmetic powder.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figures 1, 2A, 2B:
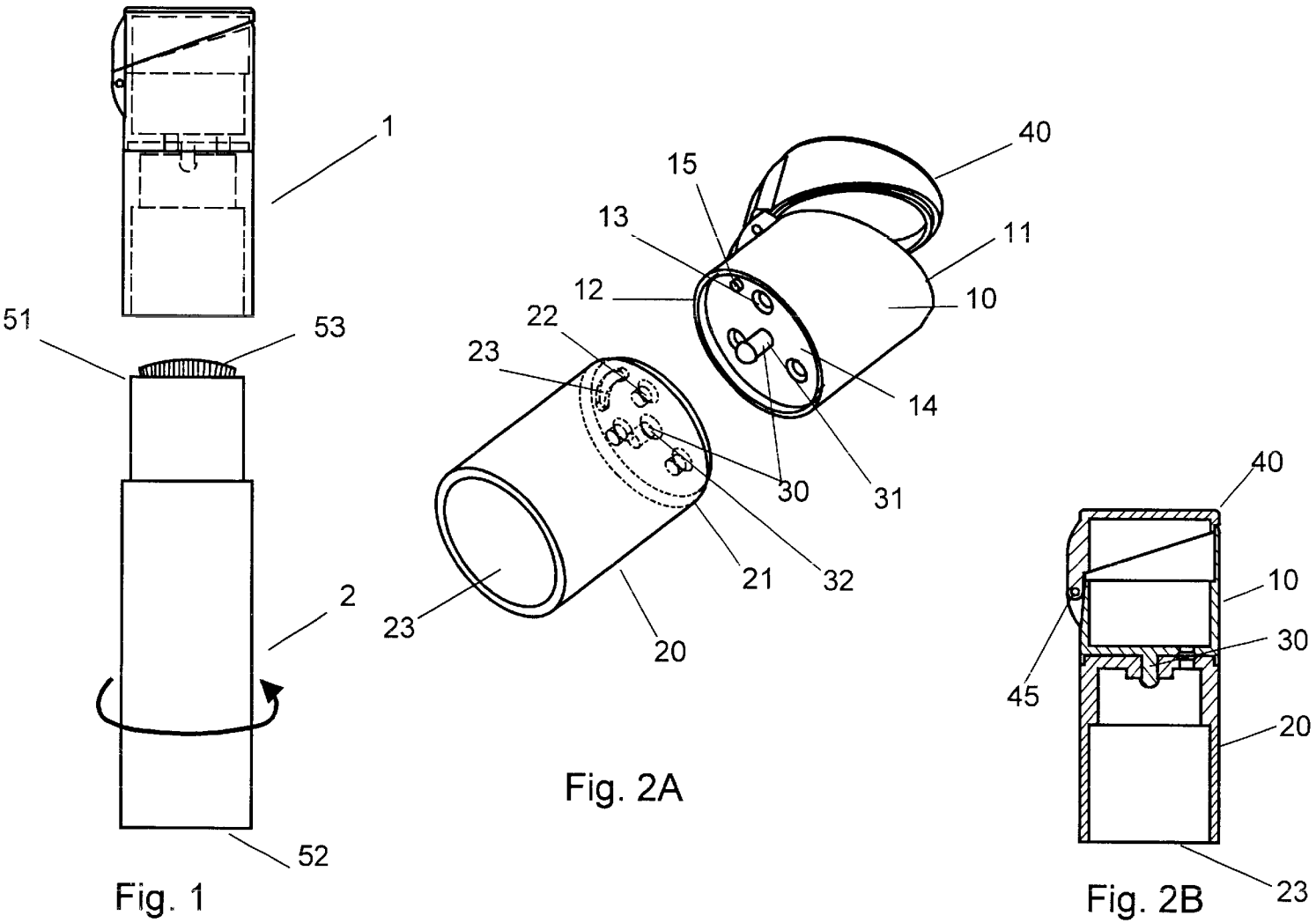
FIG. 1 is a perspective view of a refillable cosmetic powder applicator of one embodiment of the present invention.
FIG. 2A is an exploded perspective view of the refillable cosmetic powder dispenser of one embodiment of the present invention.
FIG. 2B is a cross sectional view of the refillable cosmetic powder dispenser of one embodiment of the present invention.

In one embodiment, the present invention provides a refillable cosmetic powder dispenser for use with a retractable cosmetic brush. FIG. 1 shows a refillable cosmetic powder dispenser 1 of the present invention, and a retractable cosmetic brush 2. As shown in FIGS. 2A and 2B, the refillable cosmetic powder dispenser comprises a scoop refiller 10, a brush adapter 20, a central rotational means 30, and a scoop refiller cap 40.

The scoop refiller 10 has a first and a second opposite ends. The first end 11 is open with an inclined opening in a scoop like shape for refill of cosmetic powder. The second end 12 is closed, and has a plurality of spaced openings 13 for dispensing cosmetic powder. The brush adapter 20 has a first and second opposite ends. The first end 21 is closed and has a plurality of spaced openings 22. The second end 23 is open and is used for adapting to a retractable cosmetic brush.

A central rotational means 30 connects second end 12 of the scoop refiller and first end 21 of the brush adapter. The scoop refiner and the brush adapter can be rotated manually relative to each other through central rotational means 30.

In one embodiment, the central rotational means 30 comprises an axis 31 mounted at the center of exterior side 14 of second end 12 of the scoop refiller, and a central opening 32 on first end 21 of the brush adapter for adapting axis 31. In a preferred embodiment, the refillable cosmetic powder dispenser is made of plastic material, and axis 31 can be an integral part of the scoop refiller by plastic molding. To assemble the scoop refiller and the brush adapter, axis 31 is inserted through central opening 32 on first end 21 of the brush adapter, and hot pressed from second end 23 of the brush adapter to deform the tip of axis 31 and lock axis 31 inside central opening 32. This process is commonly used in plastic industry.

In an alternative embodiment, the central rotational means can be a screw mounted at centers of second end 12 of the scoop refiller and first end 21 of the brush adapter.

The refillable cosmetic powder dispenser further comprises a positional means for aligning, or mis-aligning spaced openings 13 of the scoop refiller and spaced openings 22 of the brush adapter. FIG. 2A shows two portions of a positional means in one embodiment of the present invention. One portion of the positional means is a guiding slot 24 on exterior side 25 of first end 21 of the brush adapter. The other portion of the positional means is a switch stopper 15 on exterior side 14 of second end 12 of the scoop refiller. At the time of assembly, guiding slot 24 and switch stopper 15 are interlocked with each other.

Figure 3A:
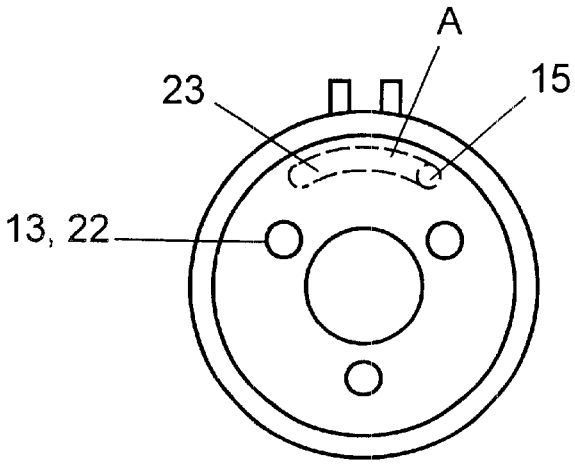
FIGS. 3A and 3C is a detailed view of spaced openings of the scoop refiller and brush adapter of one embodiment of the present invention in an aligned position.
Figure 3B:
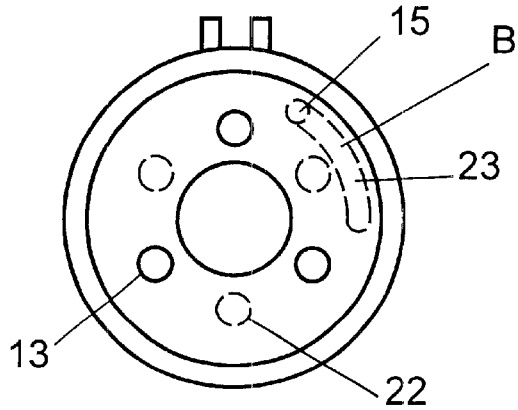
FIGS. 3B and 3D is a detailed view of spaced openings of the scoop refiller and brush adapter of one embodiment of the present invention in a mis-aligned position.
Figure 3C:
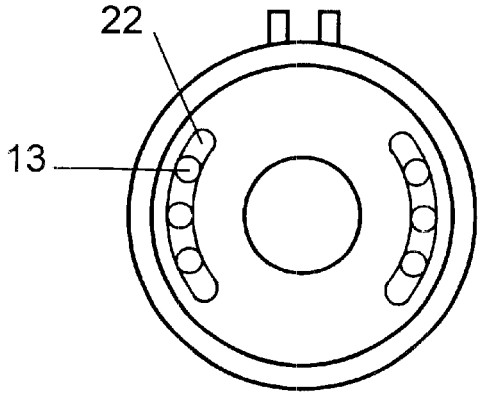
Figure 3D:
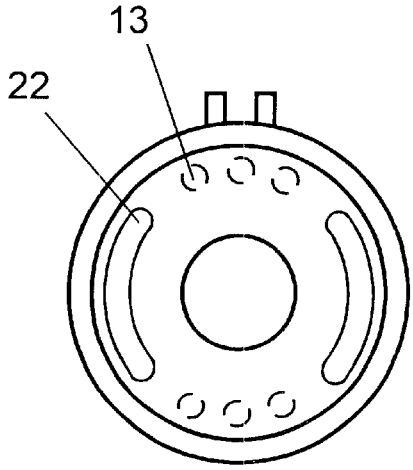

FIGS. 3A and 3B show an aligned and a mis-aligned positions between spaced openings 13 and spaced openings 22, and the mechanism of the positional means. When the positional means is at position A, spaced openings 13 and 22 are aligned, and cosmetic powder contained in the scoop refiller can be dispensed through the spaced openings. When the positional means is at position B, spaced openings 13 and 22 are mis-aligned, and cosmetic powder will be locked in the scoop refiller. On the exterior surface of the refillable cosmetic powder dispenser, a positional indicator can be marked to indicate open and close positions. To dispense cosmetic powder, the user can simply twist the scoop refiller relative to the brush adapter to a marked open position.

In FIGS. 3A and 3B spaced openings 13 and 22 are small orifices. However, other shapes of openings can also be used. Furthermore, the number and shape of spaced openings of 13, and 22 do not need to be the same. In an alternative embodiment, spaced openings 22 can be a few segments of circular slot, and spaced openings 13 can be a few sets of orifice. In this case, in an aligned position each set of orifices is positioned above each segment of circular slot. Additionally, the size of spaced openings can be determined based on the utility of the refillable cosmetic powder dispenser, and the amount of powder desired. For example, the spaced openings can be smaller for dispensing cosmetic blush, and larger for dispensing face powder.

Optionally, the brush adapter can further comprise a seal means for preventing dispensed powder falling to the regions surrounding the brush bristles. In one embodiment, the seal means is a seal layer 26 in the interior side of the brush adapter at a position right above the retractable cosmetic brush when the brush is completely inserted into the brush adapter. The seal layer can be made of the same material of the brush adapter, and molded as an integral part of the brush adapter, as shown in FIG. 2B. Alternatively, a seal ring can be built at the interior side of the brush adapter at a position right above the retractable cosmetic brush. The seal ring can be either molded as an integral part of the brush adapter, or mounted as a separate component. As a separate component, the material can be different from that of the brush adapter, for example, a rubber or a plastic ring. The cross-sectional shape of the seal ring can be round, a wedge shape, or other suitable shapes.

Figure 4:
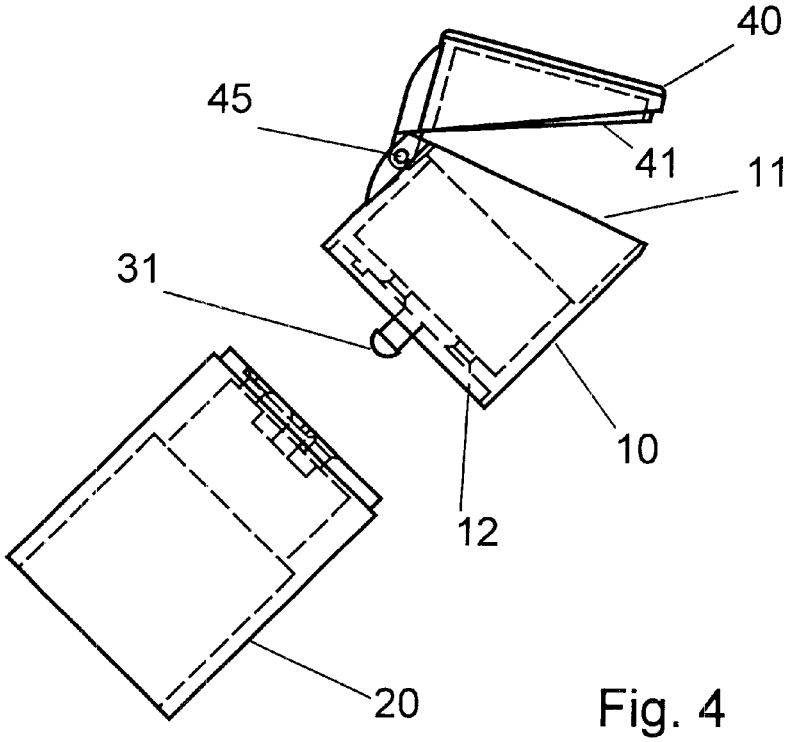
FIG. 4 is a schematic illustration of the refillable cosmetic powder dispenser with opened scoop refiller cap for refill of cosmetic powder.

The scoop refiller cap 40 is used for covering first end 11 of the scoop refiller. As shown in FIG. 4, in one embodiment scoop refiller cap 40 has a matching inclined interface 41 for secured seal of first end 11 of the scoop refiller. The scoop refiller cap can be snapped in. Optionally, scoop refiner cap 40 can be attached to the scoop refiller by a connection means, for example, by a hinge 45. Moreover, the scoop refiner cap can also be a plain plate with matching interface 41.

Figure 5A:
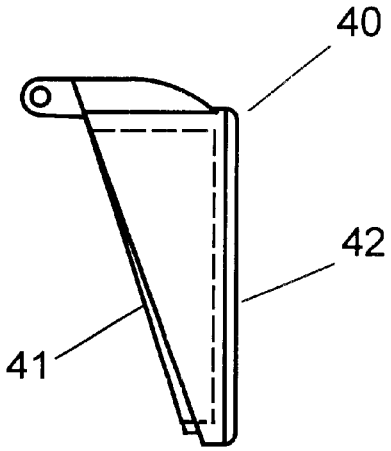
FIG. 5A is a side view of the hinged scoop refiller cap of one embodiment of the present invention.
Figure 5B:
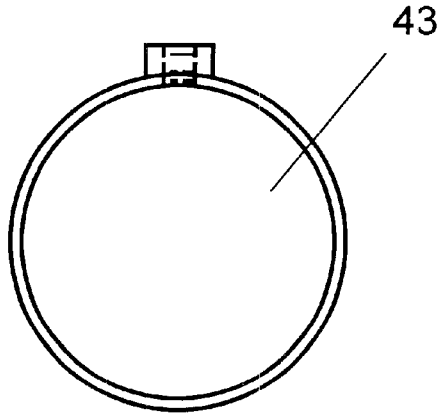
FIG. 5B is a top view of the hinged scoop refiller cap of one embodiment of the present invention.

In an additional embodiment, the refillable cosmetic powder dispenser can further comprises a mirror 43 mounted on exterior end 42 of the scoop refiller cap, as shown in FIGS. 5A and 5B. This combination provides a multifunctional cosmetic application device for the convenience of applying cosmetics, such as blush, face powder or lipstick, without carrying an additional mirror in the cosmetic pouch.

The refillable cosmetic powder dispenser of the present invention has several important advantages. First, inclined opening 11 of the scoop refiller provides a scoop function to the scoop refiller in addition to its powder storage function. Therefore, users do not need to use an additional scoop to refill the cosmetic powder dispenser. In view of dust and lost of powder occurred during handling, it is preferred to have less handling devices involved in frequent refills. More importantly, with the convenience provided by the scoop refiller of the present invention for frequent powder refills, consumers do not need to purchase more costly manufacturer pre-packed cosmetic powder capsules. The refillable cosmetic powder dispenser of the present invention is less expensive, and more convenient to the consumers. For example, if a person wants to change the cosmetic powder from one shade of color to another, she only needs to refill the scoop refiller with the new powder. Further, if a person likes a certain brand of cosmetic powder, she can continue using her favourite brand product with the refillable powder dispenser of the present invention, and will not be limited to purchasing pre-packed capsules provided by a different manufacturer.

Second, the central rotational means provides better seal around periphery of the dispenser in comparison to peripheral rotation designs used in the prior art. Using a central rotational means, interface peripheries of the scoop refiller and the brush adapter can be made with tightly matching diameters. This, in turn, prevents leak of a small amount of cosmetic powder fall between second end 12 of the scoop refiller and first end 21 of the brush adapter. This feature overcomes the problem associated with the prior art peripheral rotation designs, where if the peripheries tightly match it could be difficult to rotate the scoop refiller and the brush adapter for dispensing powder, and if the peripheries loosely match the dispenser could leak cosmetic powder. Furthermore, using the central rotational means to connect the scoop refiller and the brush adapter provides ease in manufacturing assembly of the dispenser.

Third, in the preferred embodiment the refillable cosmetic powder dispenser has a hinged scoop refiller cap, which secures the cap for sealing cosmetic powder in the dispenser. This is an important feature for personal cosmetic device used for travelling.

The refillable cosmetic powder dispenser of the present invention is adaptable to commercially available retractable cosmetic brush. It can be sold as an add-on dispenser for existing cosmetic brushes, or sold as an optional addition to a cosmetic brush for travel or carry-on use only.

In a further embodiment, the present invention provides a refillable cosmetic powder applicator comprising the refillable cosmetic powder dispenser described above, and a retractable cosmetic brush 2 adaptable to the refillable cosmetic powder dispenser. The retractable cosmetic brush comprises a brush holder 50 which has a open end 51 and an opposite closed end 52, brush bristles 53 disposed in the brush holder, and a retraction means (not shown in the figure) for moving said brush bristles vertically out and in the open end of the brush holder. The open end 51 can be inserted into second end 23 of the brush adapter of the refillable cosmetic powder dispenser. Seal layer 26, as shown in FIG. 2B, is right above open end 51 when 51 is completely inserted into brush adapter 20.

FIG. 1 illustrates a twist motion for extending the brush bristles out the brush holder, or retracting the brush bristles into the brush holder. Alternatively, a retraction means providing a vertical sliding motion for extending or retracting the brush bristles can also be used.

To use the refillable cosmetic powder applicator, an user can twist the scoop refiller to the aligned position, tap on the scoop refiller cap to dispense cosmetic powder, twist the scoop refiner back to the mis-aligned position, take the refillable cosmetic powder dispenser off from the brush holder, and extend the brush bristles out of the brush holder, and apply cosmetic powder.

In an additional embodiment, the present invention also provides a kit that comprises a refillable cosmetic powder applicator of the present invention, and cosmetic powder. The kit can further comprise instructions on how to use the refillable cosmetic powder applicator.

While the present invention has been described in detail and pictorially shown in the accompanying drawings, these should not be construed as limitations on the scope of the present invention, but rather as an exemplification of preferred embodiments thereof. It will be apparent, however, that various modifications and changes can be made within the spirit and the scope of this invention as described in the above specification and defined in the appended claims and their legal equivalents.

I claim:

1. A refillable cosmetic powder dispenser comprising:

a scoop refiller having a first and a second opposite ends, said first end being open with an inclined opening in a scoop like shape for refill of a cosmetic powder, and said second end being closed, and having a plurality of spaced openings for dispensing said cosmetic powder, a scoop refiller cap for covering said first end of said scoop refiller, a brush adapter having a first and second opposite ends, said first and being closed and having a plurality of spaced openings and said second end being open for adapting to a cosmetic brush, and a center rotational means connecting said second end of said scoop refiller and said first end of said brush adaptor, wherein said scoop refiller and said brush adapter can be rotated relative to each other through said center rotational means.

2. The refillable cosmetic powder dispenser of claim 1, wherein said scoop refiller cap is connected to said scoop refiller through a connection means.

3. The refillable cosmetic powder dispenser of claim 2, wherein said a connection means is a hinge.

4. The refillable cosmetic powder dispenser of claim 1, wherein said refillable cosmetic powder dispenser further comprises a mirror mounted on an exterior end of said scoop refiner cap.

5. The refillable cosmetic powder dispenser of claim 1, wherein said center rotational means comprises an axis connected at a center of an exterior side of said second end of said scoop refiller, and a central opening on said first end of said brush adapter for adapting said axis.

6. The refillable cosmetic powder dispenser of claim 1, wherein said brush adapter further comprises a seal means in the interior of said brush adapter for preventing dispensed powder falling to regions surrounding brush bristles of said cosmetic brush.

7. The refillable cosmetic powder dispenser of claim 1, wherein said scoop refiller and said brush adapter have same numbers of said spaced openings, said openings can be aligned through rotation of said scoop refiller and said brush adapter relative to each other.

8. The refillable cosmetic powder dispenser of claim 1, wherein said spaced openings of said scoop refiller are different in number and shape from said spaced openings of said brush adapter, said openings can be aligned through rotation of said scoop refiller and said brush adapter relative to each other.

9. The refillable cosmetic powder dispenser of claim 1 further comprising a positional means for aligning and misaligning said spaced openings of said scoop refiller and said brush adapter.

10. A refillable cosmetic powder applicator comprising:

(a) a refillable cosmetic powder dispenser comprising:

a scoop refiller having a first and a second opposite ends, said first end being open with an inclined opening in a scoop like shape for refill of a cosmetic powder, and said second end being closed, and having a plurality of spaced openings for dispensing said cosmetic powder, a scoop refiller cap for covering said first end of said scoop refiller, a brush adapter having a first and second opposite ends, said first end being closed and having a plurality of spaced openings and said second end being open for adapting to a cosmetic brush, and a center rotational means connecting said second end of said scoop refiller and said first end of said brush adapter, wherein said scoop refiller and said brush adapter can be rotated relative to each other through said center rotational means, and (b) a retractable cosmetic brush adaptable to said refillable cosmetic powder dispenser.

11. The refillable cosmetic powder applicator of claim 10, wherein said retractable cosmetic brush comprising:

a brush holder having a open end and an opposite closed end, said open end being insertable into said brush adapter of said refillable cosmetic powder dispenser, brush bristles disposed in said brush holder, and a retraction means for moving said brush bristles vertically out and in said open end of said brush holder.

12. The refillable cosmetic powder applicator of claim 10, wherein said scoop refiller cap is connected to said scoop refiller through a connection means.

13. The refillable cosmetic powder applicator of claim 10, wherein said refillable cosmetic powder dispenser further comprises a mirror mounted on an exterior end of said scoop refiller cap.

14. The refillable cosmetic powder applicator of claim 10, wherein said center rotational means comprises an axis connected at a center of an exterior side of said second end of said scoop refiller, and a central opening on said first end of said brush adapter for adapting said axis.

15. The refillable cosmetic powder dispenser of claim 10, wherein said brush adapter further comprises a seal means in the interior of said brush adapter for preventing dispensed powder falling to regions surrounding said brush bristles of said retractable cosmetic brush.

16. The refillable cosmetic powder applicator of claim 10, wherein said scoop refiller and said brush adapter have same numbers of said spaced openings, said openings can be aligned through rotation of said scoop refiller and said brush adapter relative to each other.

17. The refillable cosmetic powder applicator of claim 10, wherein said spaced openings of said scoop refiller are different in number and shape from said spaced openings of said brush Adapter, said openings can be aligned through rotation of said scoop refiller and said brush adapter relative to each other.

18. The refillable cosmetic powder applicator of claim 10 further comprising a positional means for aligning and miss-aligning said spaced openings of said scoop refiller and said brush adapter.

19. A cosmetic kit comprising:

(a) a refillable cosmetic powder dispenser comprising:

a scoop refiller having a first and a second opposite ends, said first end being open with an inclined opening in a scoop like shape for refill of a cosmetic powder, and said second and being closed, and having a plurality of spaced openings for dispensing said cosmetic powder, a scoop refiller cap for covering said first end of said scoop refiller, a brush adapter having a first and second opposite ends, said first end being closed and having a plurality of spaced openings and said second end being open for adapting to a cosmetic brush, and a center rotational means connecting said second end of said scoop refiller and said first end of said brush adapter, wherein said scoop refiller and said brush adapter can be rotated relative to each other through said center rotational means, (b) a retractable cosmetic brush adaptable to said refillable cosmetic powder dispenser, and (c) cosmetic powders.

20. The kit of claim 19 further comprising instructions on how to use said refillable cosmetic powder applicator.

* * * * *